US005478011A

United States Patent [19]

Pham

[11] Patent Number: 5,478,011

[45] Date of Patent: Dec. 26, 1995

[54] INTERLOCKING CLOSURE FOR HINGED LID BOXES

[75] Inventor: Xuan M. Pham, Richmond, Va.

[73] Assignee: Focke & Co (GmbH & Co.,), Verden, Germany

[21] Appl. No.: 573,883

[22] Filed: Aug. 28, 1990

[51] Int. Cl.[6] ..... B65D 43/16

[52] U.S. Cl. ..... 229/160.1; 229/148

[58] Field of Search ..... 229/160.1, 148, 229/182.1; 206/271, 273

[56] References Cited

U.S. PATENT DOCUMENTS

| | | | |
|---|---|---|---|
| 887,953 | 5/1908 | Moonert et al. . | |
| 2,369,387 | 2/1945 | Williamson et al. . | |
| 2,369,391 | 2/1945 | Ringler . | |
| 2,387,392 | 10/1945 | Guyer et al. | 229/182.1 |
| 2,515,327 | 7/1950 | Bergstein . | |
| 2,777,629 | 1/1957 | Osteen | 229/145 |
| 2,836,342 | 5/1958 | Ringler . | |
| 2,963,214 | 12/1960 | Leone et al. | 229/146 |
| 3,018,031 | 1/1962 | Ahlbor et al. . | |
| 3,078,030 | 2/1963 | Gorton . | |
| 3,090,540 | 5/1963 | Arneson | 229/148 |
| 3,523,636 | 8/1970 | Phillips, Jr. . | |
| 3,608,812 | 9/1971 | Hamilton | 229/145 |
| 3,642,194 | 2/1972 | Scully | 229/145 |
| 3,794,238 | 2/1974 | Egli . | |
| 3,910,487 | 10/1975 | Jaeschke . | |
| 3,942,712 | 3/1976 | Bundy et al. . | |
| 3,944,066 | 3/1976 | Niepmann . | |
| 3,963,173 | 6/1976 | Stone . | |
| 4,048,052 | 9/1977 | Tolaas . | |
| 4,114,777 | 9/1978 | Frohling et al. | 229/160.1 |
| 4,150,748 | 4/1979 | Mueller . | |
| 4,216,898 | 8/1980 | Davies | 229/160.1 |
| 4,284,197 | 8/1981 | Meyers | 229/159 |
| 4,303,191 | 12/1981 | Foster et al. . | |
| 4,314,643 | 2/1982 | Forbes, Jr. . | |
| 4,381,071 | 4/1983 | Vergiels | 229/148 |
| 4,526,317 | 7/1985 | Cassidy . | |
| 4,569,475 | 2/1986 | Cassidy | 229/146 |
| 4,733,796 | 3/1988 | Halverstadt et al. . | |
| 4,753,383 | 6/1988 | Focke et al. . | |
| 4,753,384 | 6/1988 | Focke et al. . | |
| 4,852,734 | 8/1989 | Allen et al. . | |
| 4,948,038 | 8/1990 | Moeller | 229/146 |
| 4,955,531 | 9/1990 | Graboyes | 229/182.1 |

FOREIGN PATENT DOCUMENTS

| | | | |
|---|---|---|---|
| 2303720 | 3/1976 | France . | |
| 3624345A1 | 7/1986 | Germany . | |
| 1572897 | 8/1980 | United Kingdom | 206/268 |

*Primary Examiner*—Allan N. Shoap
*Assistant Examiner*—Christopher McDonald
*Attorney, Agent, or Firm*—Sughrue, Mion, Zinn, Macpeak & Seas

[57] ABSTRACT

A hinged lid box having an innerframe and interlocking means for maintaining the box substantially closed. The interlocking means includes a panel of material including a tab that is secured to the inside of the front panel of the lid so that the tab is opposed to but not secured to the lid surface whereby the tab is disposed to pass inside the innerframe during closure. The innerframe is thus frictionally engaged by the tab and the opposing surface of the front panel of the lid to retain the lid closed. The tab may be formed by a slit in the panel of material and provided with a score line to facilitate bending the tab at the desired location to engage the innerframe. The tab also may be formed by cutting a notch in the panel, thereby providing a space between the tab and the panel from which the tab is cut. The notch may be provided with a configuration that facilitates inserting the tab behind the innerframe. Means for raising the tab a distance above the surface of the panel of material also may provided. More than one tab may be used, preferably two tabs spaced apart and proximate to the front corners of the lid. The interlocking means is suitable for boxes having rounded corners.

24 Claims, 5 Drawing Sheets

Fig. 9
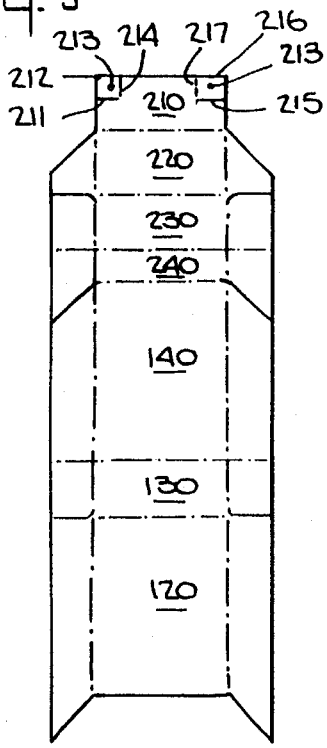
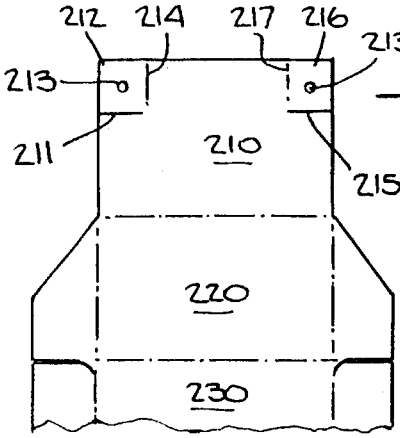
Fig. 9A
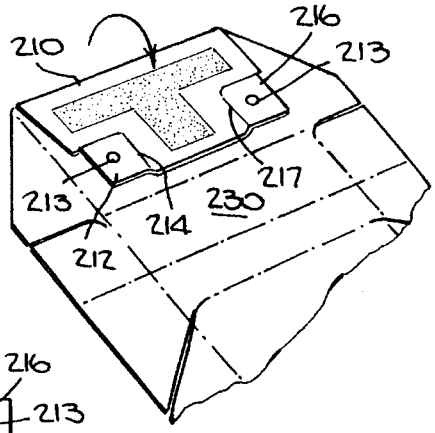
Fig. 9B
Fig. 10
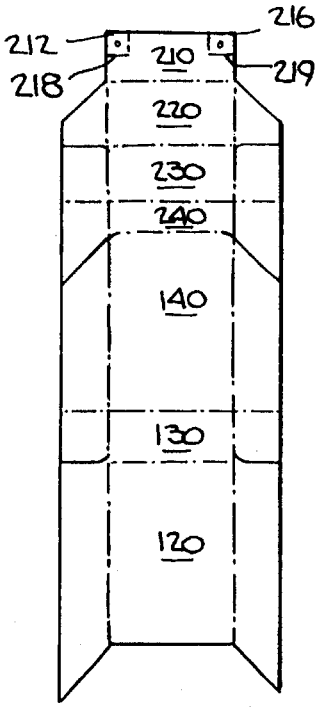
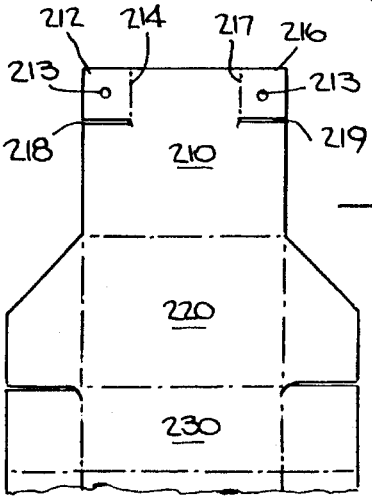
Fig. 10A
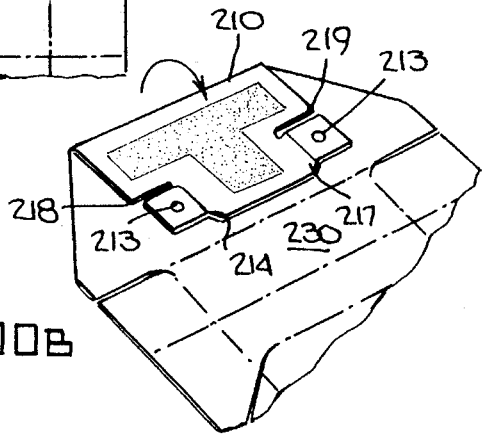
Fig. 10B

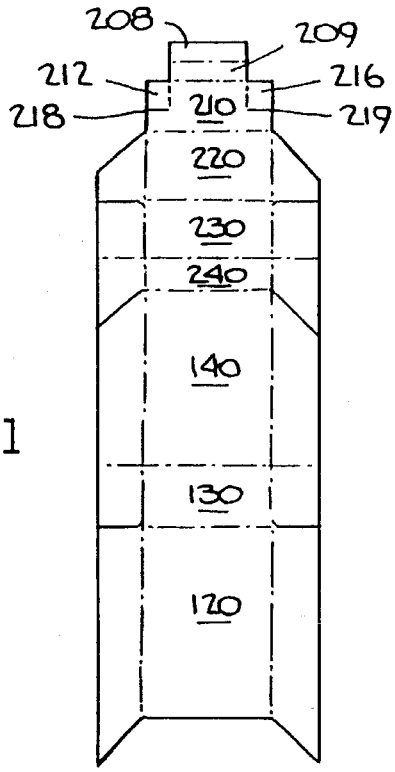
Fig. 11
Fig. 11A
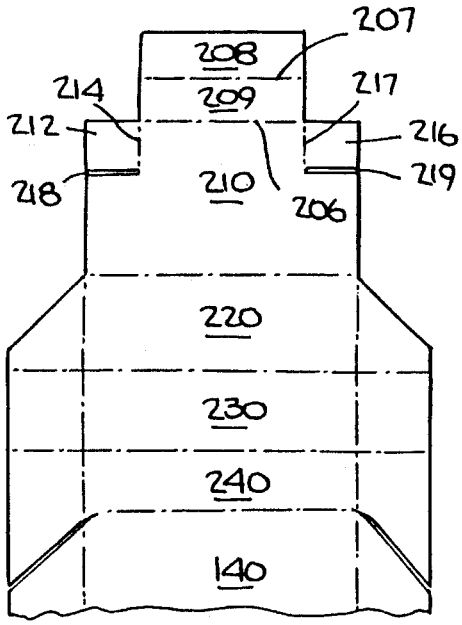
Fig. 11B
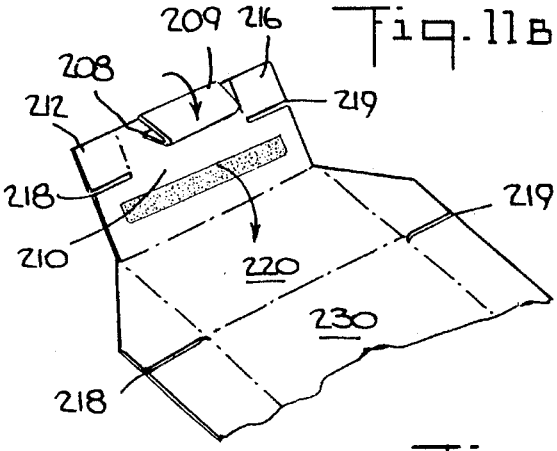
Fig. 11C
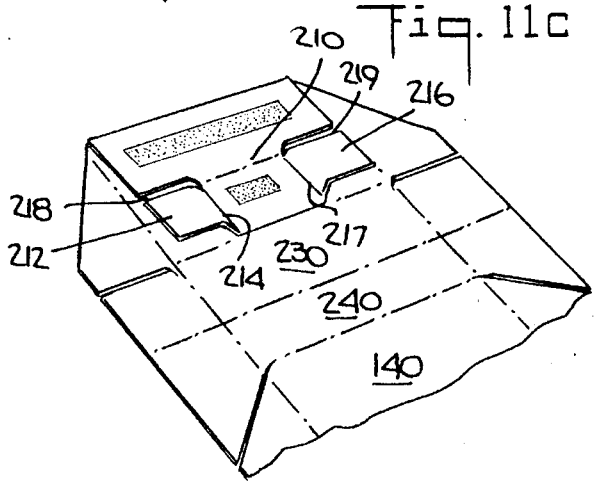

INTERLOCKING CLOSURE FOR HINGED LID BOXES

BACKGROUND OF THE INVENTION

This invention relates to boxes having a hinge connecting the box lid to the box body, and particularly to maintaining closed the lid of a hinged lid box having rounded corners for containing smoking articles such as cigarettes.

One type of package in which cigarettes are sold is a hard paperboard box having a hinged lid. A hard paperboard innerframe is secured to the front of the box body and extends out the body. The cigarettes are bundled in a foil liner inside the box body and are at least partially surrounded by the innerframe. The box lid fits over the innerframe and the cigarettes. The innerframe provides a frictional engagement surface to retain the lid in the closed position and protects the cigarettes that extend above the box body from damage.

Conventional hinged lid boxes have a flat panel at the lower edge of the front panel that is folded 180 degrees and secured to the inside surface of the lid front panel. This flap extends substantially the width of the lid front panel and is typically less than one half of the height of the lid front panel. The flap increases the rigidity of the lid front panel and provides a smooth, non-cut lower edge.

Hinged top boxes are made with substantially right angle corners or with rounded corners. It is important for each style of box to maintain the box lid closed so that the box will not open inadvertently and spill its contents, for example, smoking articles or loose particles of smoking material such as tobacco. The box lid closure should also be aesthetically pleasing to enhance the general appearance and consumer acceptance of the box.

One known technique for maintaining right angle corner boxes closed includes providing the innerframe with u-shaped slits or retention cuts at the innerframe corners so that when the innerframe is folded, u-shaped tabs extend outwardly from each corner in the plane of the innerframe front panel. Thus, when the lid is closed, the tabs engage the interior side panels of the rectangular lid, pressing the lid sides apart and holding the lid tightly against the innerframe.

U.S. Pat. No. 4,753,383 refers to applying the innerframe corner tab technique to boxes having rounded corners. However, the tabs formed on the innerframe corners do not engage adequately the lid corners to press the lid sides apart or to hold the lid closed. Rather, the tabs are either sheared off or damaged by the bottom edge of the lid as the lid is closed, or urged to follow the curvature of the corners by the forces acting on the tabs from the lid corners and thus pushed back into the slits from which the tabs were cut. The result in either case is that forces exerted between the lid and the innerframe are insufficient to hold the lid sufficiently closed, notwithstanding that the lid may be mostly closed. The partial opening is unacceptable in a commercial product because it permits inadvertent opening of the box, leakage of the contents, and, in particular, results in an package that is unattractive and unacceptable to the consumer.

U.S. Pat. No. 4,753,383 also refers to maintaining a lid closed by cutting the front panel of the innerframe to form an anchoring tab. The anchoring tab is folded back 180 degrees onto the innerframe front panel so that the bottom edge of the anchoring tab will engage the top surface of a reinforcing strip that is secured to the inside surface of the lower edge of the lid front panel. When the lid is closed, the anchoring tab and the reinforcing strip are in end to end abutment in the same plane. This technique has not appeared in any commercial product. It is believed to be impractical due to the close tolerances required and the difficulty of maintaining the end to end abutment following repeated disengagement of the anchoring tab and the lid and the undesirable presence of the anchoring tab on the innerframe.

Accordingly, there is a continuing need for apparatus and methods for closing box lids for rounded corner hinged lid boxes that are easy to manufacture, aesthetically suitable, and maintain the box fully closed even after repeated use.

SUMMARY OF THE INVENTION

It is an object of this invention to provide an improved closure mechanism for maintaining the lid of a box securely closed.

It is another object of this invention to provide a method and apparatus interlocking the lid to the body of the box. It is another object to interlock the lid to the innerframe of the box during each reclosure of the box throughout its utilization.

It is another object of this invention to provide an interlock that easily captures the innerframe during each closure.

In accordance with the invention, a hinged lid box is provided having an interlock for frictionally engaging the box lid to the innerframe of the box, thereby maintaining the box lid closed. Broadly, the invention provides for an additional panel of material having a tab that is secured in superposition to the inside of the front panel of the lid. The tab extends from the additional panel (also referred to as the "second lid front panel" or "second panel") and is disposed to pass inside the innerframe of the box during closure of the lid. The tab may be a protruding area extending from the second panel, or more preferably a cut out portion of the second panel defined by, for example, one or more slits. The other portions of the second lid front panel pass on the outside of the innerframe.

Thus, when the lid is closed, the innerframe is frictionally engaged on the inside by the tab and on the outside by the portion of the front lid panel in superposition to the tab on the outside and the other portions of the second panel of material. The size of the tab and the spacing between the tab and the opposing portion of the first lid panel are selected so that the second panel of material will frictionally engage the innerframe with sufficient force to retain the box lid closed.

In a preferred embodiment, the second lid front panel has a first tab and a second tab disposed a distance apart on the second panel so that the tabs engage separate portions of the innerframe. The tabs may be formed by a pair of slits extending from the same edge (or different edges) of the second panel to the interior. Thus, tabs may be formed to engage the top edge of the innerframe or a side edge of the innerframe or some combination of both. Preferably, the innerframe is provided with a cut out portion in the front and the second panel is provided with a pair of tabs defined by horizontal slits. In this embodiment, the tabs point outwardly and engage and slide along the vertical side edge of the innerframe at the top of the box as the lid is closed.

Preferably, each tab that is to pass inside the innerframe is provided with a score line defining the location about which the tab may bend to fit behind the innerframe tab. Score lines facilitate bending of the tab in a selected location so that the tab will engage the inside of the innerframe and minimize binding of the tab during closure.

In one embodiment of the invention, the slit or slits defining a tab may comprise one or more cut out portion referred to as notches, for example, U-shape, V-shape or other shape notches, that extend a distance from the end of the tab towards the interior of the second panel. The notch also may be provided with a suitable shape that facilitates insertion of the tab behind the innerframe during closure. The notches provide a space between the one edge of the tab and the adjacent portion of the second panel of at least the thickness of the innerframe wall that is to be straddled by the tab. The notch configuration thus will minimize the likelihood of scratching or distorting the innerframe (which may be a foil paperboard laminate) during reclosure and storage, and will ease the movement of the tab between the innerframe wall and the product contained inside the box without deforming the tab.

In a preferred embodiment, each tab is located proximate to the top edge of the box lid front panel. This provides for the bottom edge of the box lid front panel pressing on the innerframe top portions and guiding the innerframe under the tabs. The tabs, which are not secured to the lid panels, are caused to extend from the lid surface by the action of the innerframe distorting the first lid front panel somewhat.

In accordance another embodiment of this invention, the second panel of material is further provided with score lines, perforations, embossed lines or dots at or adjacent the tabs or other means for raising the tabs from the lid front panel surface so that at least a portion of the tabs are spaced from an inside surface of the front lid panel. The raising means operates to make is easier for the tabs to pass inside the innerframe walls during closure by providing a gap between the tabs and the underlying first front panel of the lid and minimize the need to distort the box lid and innerframe as might be necessary to splay tabs not having a raising means. Preferably, the base of the tabs are defined by score lines in the second panel that are perpendicular to the edge of the innerframe walls that the tabs are to engage to facilitate insertion of the tabs in the desired location.

In one embodiment, the means for raising the tabs comprises an area embossed in the tab, e.g., a bead or dot, which contacts the lid panel under the second panel of material and raises the surrounding tab area above the lid panel.

In an alternate embodiment, the raising means comprises a third panel of material that is interposed between the second panel of material and the lid front panel in the region of the second panel so that the tabs are raised off the surface of the lid front panel. In yet another embodiment, the third panel may comprise one or more additional superimposed panels so that the distance between the opposing surfaces of the leading tabs and the lid panel is sufficient to permit the leading tabs to pass inside the innerframe. Preferably, the second panel includes two tabs horizontally aligned and oppositely disposed and the third panel has a width that extends between the bases of the two tabs and a height that is about the same as the height of the two tabs. This results in the tabs overhanging the third panel spaced a distance from and above the first panel.

Advantageously, the box is formed from a single blank having suitable slits and score lines for erecting the hinged lid box into a rounded corner shape. The second panel of material, preferably with laterally extending tabs, may be formed integral with the single blank as an extension to the lid front panel and a horizontal slit may be made at each side of the additional panel, preferably at about midway between the top and bottom of the panel. In this preferred embodiment, a score line could be used to define the lid front panel and the second panel of material, whereby the second panel may be folded along the score line 180 degrees back onto the inside of lid front panel during erection of the box. Preferably, the height dimension of the second panel is such that it extends over an upper inside portion of the lid front panel, i.e., greater than 50% of the height of the lid front panel, more preferably from 75% to about 95% to permit some tolerance for assembly and increased front panel surface area.

In accordance with the above embodiments including a raising means, the tabs could be embossed during formation of the blank so that when the second panel is folded, the raised embossed areas are in contact with the inside of the lid front panel. Also, the third panels of material may be formed integral with the blank as extensions from the second panel of material, defined by a score line forming the border of the second panel of material and having a width appropriate to the distance between the innermost edges of the slits or notches, for example, a width extending between the score lines defining the base of the tabs. The third panel may comprise two panels defined by another score line so that the third panel is folded 180 degrees about its score line and then the folded panels are folded 180 degrees to contact the added panel, thereby forming the raising means having a double thickness of the blank. The score lines separating the third and second panels (and the two areas of the third panel) and transecting the third panel may be a series of perforations to obtain a flat fold.

BRIEF DESCRIPTION OF THE DRAWINGS

The above and other objects and advantages of the invention will be apparent upon consideration of the following detailed description, taken in consideration with the accompanying drawings, in which like reference characters refer to like parts throughout, and in which:

FIG. 9 is a plan schematic view of a one-piece blank for a box in accordance with an embodiment of the present invention;

FIG. 9A is a partial enlarged view of FIG. 9;

FIG. 9B is an elevational perspective view illustrating a portion of the assembly of the blank of FIG. 9;

FIG. 10 is a plan schematic view of a one-piece blank for a box in accordance with an embodiment of the present invention;

FIG. 10A is a partial enlarged view of FIG. 10;

FIG. 10B is an elevational perspective view illustrating a portion of the assembly of the blank of FIG. 10;

FIG. 11 is a plan schematic view of a one-piece blank for a box in accordance with an embodiment of the present invention;

FIG. 11A is a partial enlarged view of FIG. 11;

FIG. 11B and 11C are an elevational perspective views illustrating a portion of the assembly of the blank of FIG. 11.

DETAILED DESCRIPTION OF THE INVENTION

Figure 1:
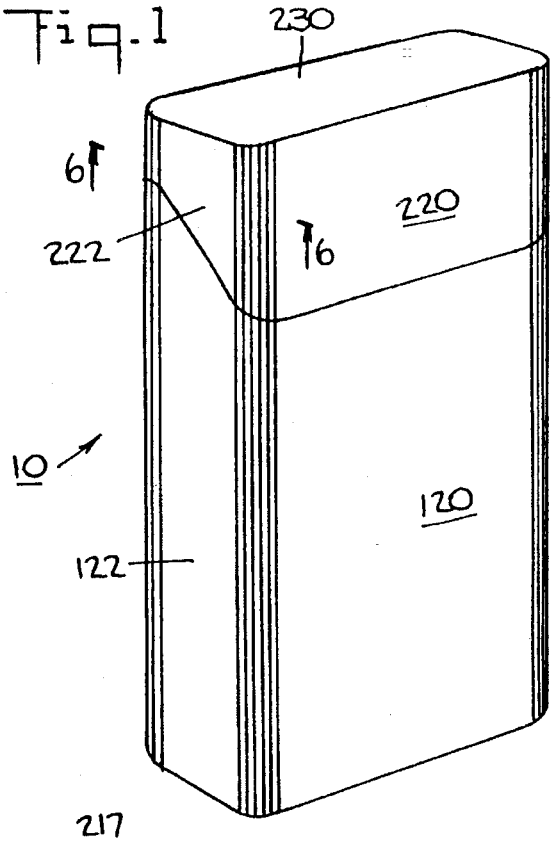
FIG. 1 is an elevational perspective view of a rounded corner box in accordance with an embodiment of the present invention.
Figure 2:
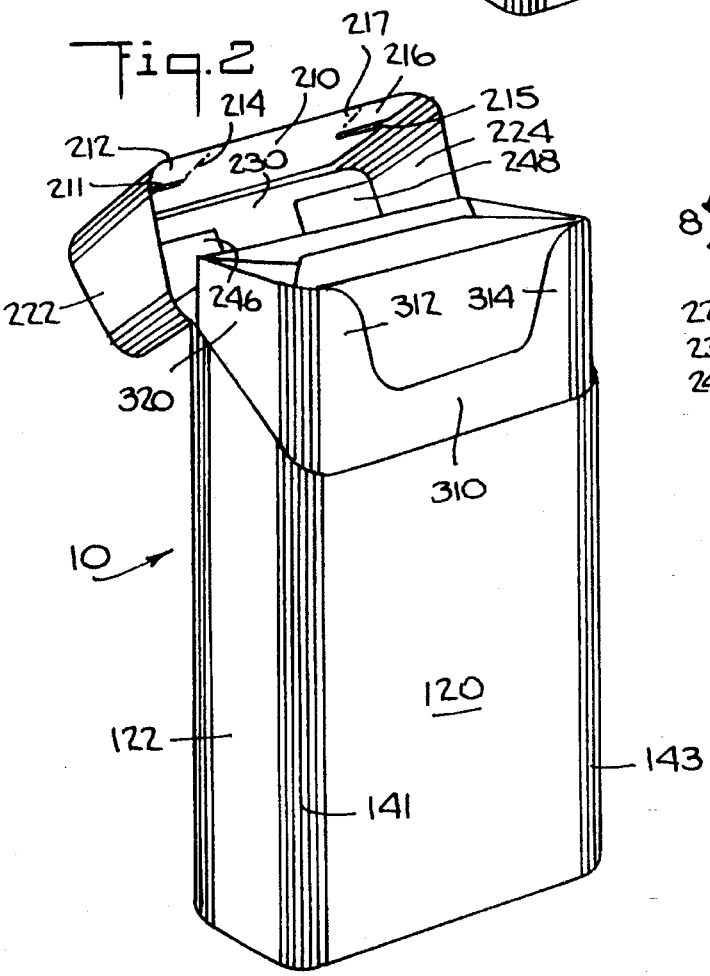
FIG. 2 is an elevational perspective view of the box of FIG. 1 in an open position.
Figure 4:
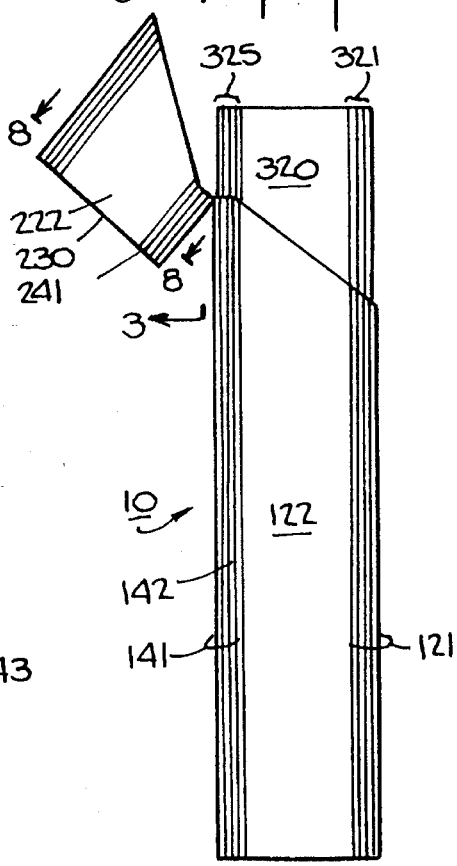
FIG. 4 is a side elevational view of the box of FIG. 2
Figure 3:
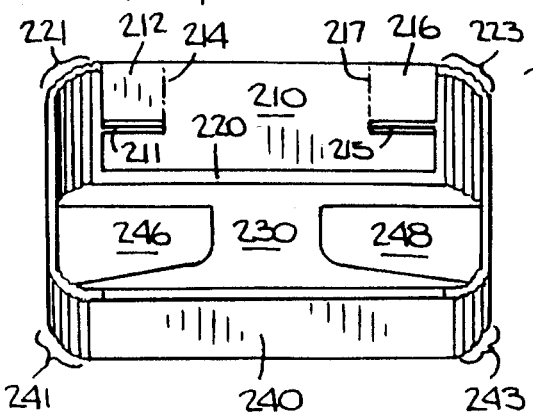
FIG. 3 is a front elevational view of the box lid of FIG. 2.

As shown in FIGS. 1–8, a hinged lid box 10 incorporating an illustrated embodiment of the present invention is shown. Box 10 includes a body 100 and a lid 200 hinged together at the rear of box 10, and an innerframe member 300 that is secured at the front of body 100 and extending out of body 100. Box 10 has in its closed condition a generally rectangular configuration comprising a plurality of flat panels including a top panel 230, a bottom panel 130, a front surface comprising a front body panel 120 and a front lid panel 220, a rear surface comprising a rear body panel 140 and a rear lid panel 240, a left side surface comprising a side body panel 142 and a side lid panel 242, and a right side surface comprising a side body panel 144 and a side lid panel 244. Top panel 230 and bottom panel 130 are substantially parallel when box 10 is closed and at an angle to each other when box 10 is open.

The flat panel surfaces are connected by rounded corners such that, for body 100, front panel 120 is connected to left front side panel 122 by corner radius area 121, left front side panel 122 is secured in superposition to and outside of left rear side panel 142, panel 142 is in turn is connected to rear panel 140 by corner area 141, rear panel 140 is connected to right rear side panel 144 by corner radius area 143, right rear side panel 144 is secured in superposition to and inside of right front side panel 124, and panel 124 is in turn connected to front panel 120 by corner radius area 123.

Similarly, for lid 200, front panel 220 is connected to left front side panel 222 by corner radius area 221, left front side panel 222 is secured in superposition to and outside of left rear side panel 242, panel 242 is in turn connected to rear panel 240 by corner area 241, rear panel 240 is connected to right rear side panel 244 by corner radius area 243, right rear side panel 244 is secured in superposition to and inside of right front side panel 224, and panel 224 is in turn connected to front panel 220 by corner radius area 223.

Figure 5:
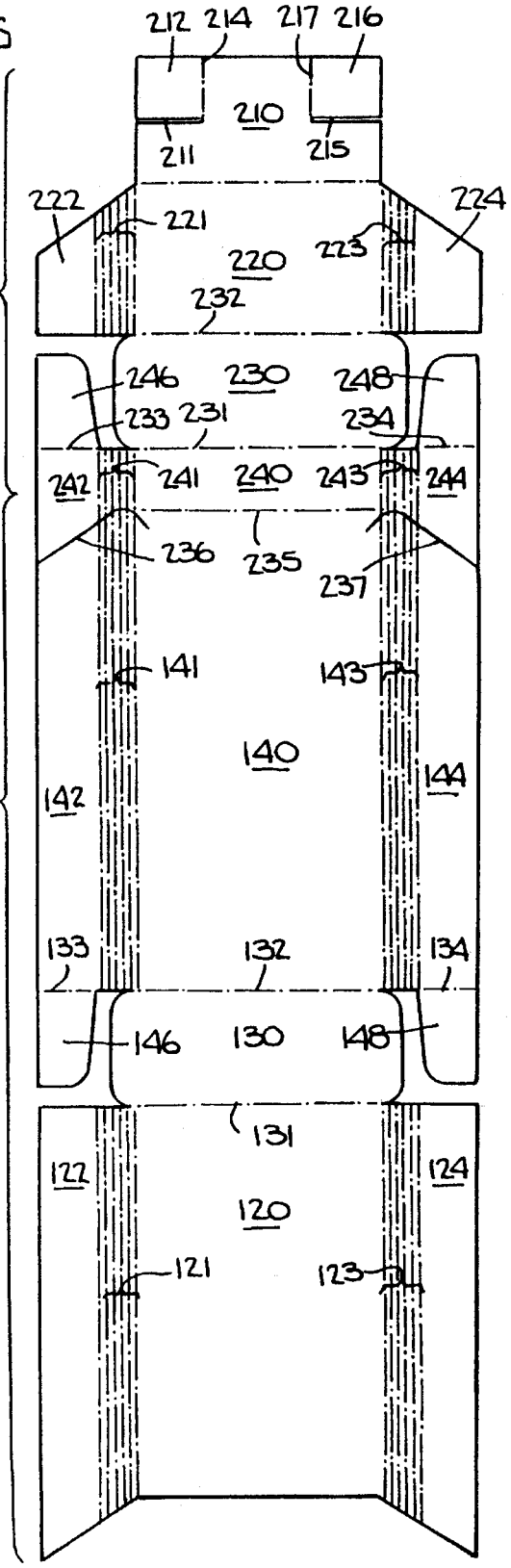
FIG. 5 is a plan view of a one-piece blank for the box of FIG. 1.
Figure 7:
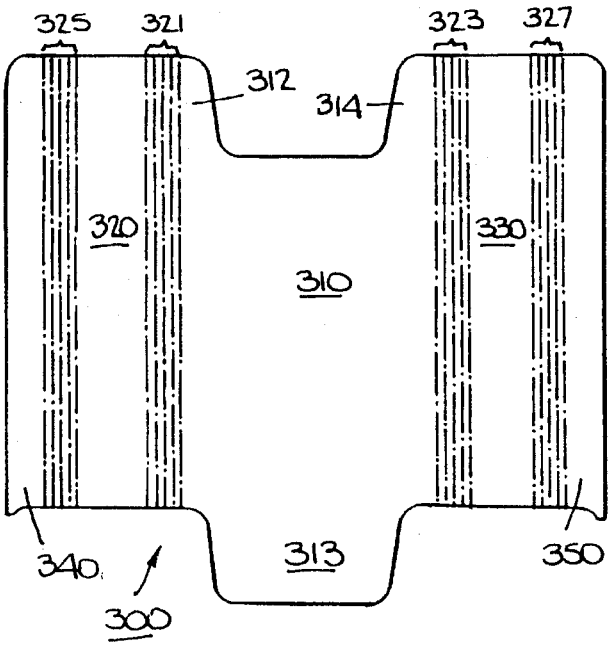
FIG. 7 is a plan view of a one-piece blank for an innerframe of FIG. 2.
Figure 6:
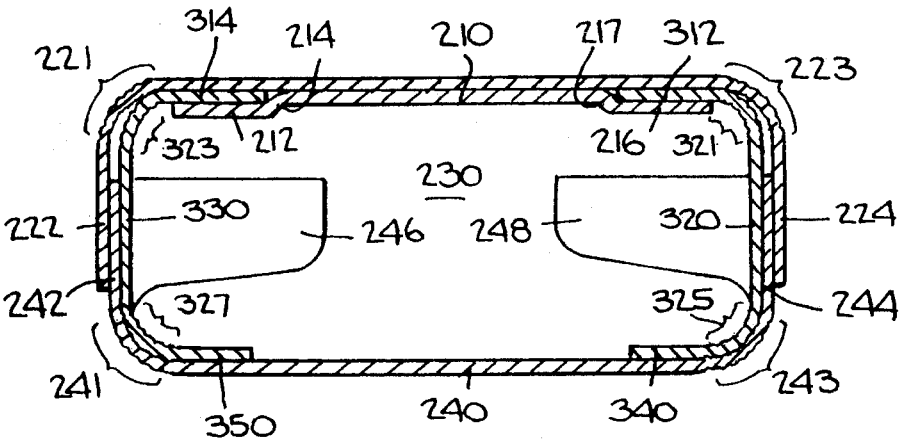
FIG. 6 is a sectional view taken along line 6—6 of FIG. 1.

In assembling box 10 from the blank shown in FIG. 5, body tabs 146 and 148 are respectively secured to the interior of bottom panel 130, and body side panels 142 and 144 are respectively secured in superposition to and inside of side panels 122 and 124, thereby forming a stable box body have four rounded corners, parallel front and rear panels, parallel side panels, and a square rounded corner bottom configuration that will stand on its bottom panel. Bottom panel 130 is in a plane that is perpendicular to bottom front panel 120, side panels 122 and 124 and rear panel 140.

Similarly, lid tabs 246 and 248 are secured to the interior of lid panel 230 and lid side panels 242 and 244 are respectively secured in superposition to and inside of lid panels 222 and 224 to provide a lid having corners, front, rear and side panels that are in alignment with and parallel to the corresponding body corners and panels. Top panel 230 is in a plane that is perpendicular to lid front panel 220, rear panel 240, side panels 222 and 224, and corner radius areas 221, 223, 241, and 243.

The blank is provided with score lines for bending the panels into the erected box configuration. Score lines 131 and 132 provide for respectively bending body front panel 120 and rear panel 140 ninety degrees relative to bottom 130, and score lines 133 and 134 provide for respectively bending tabs 146 and 148 ninety degrees so that they can be affixed to bottom 130. Similarly, score lines 231 and 232 provide for respectively bending lid front panel 220 and rear panel 240 ninety degrees relative to top panel 230, and score lines 233 and 234 provide for respectively bending tabs 246 and 248 ninety degrees so that they can be affixed to top panel 230.

Box 10 also is provided with an articulated hinge comprising score line 235 and slits 236 and 237. Slits 236 and 237 are mirror images of each other having a long slit in the area that forms the side panels and corners and a short slit in the area that forms the box rear. The long slits are made at an angle to the edge of the package blank which provide an angled edge or miter between the lid and body, preferably at an angle of 34.5 degrees. The short slits are interior to corner areas 241 and 243 and below score line 235, and preferably are at a mirror image angle that is the same angle as the miter of the long slits. The long slits also may include cutting a notch or removing a small area of the blank, preferably in the form of an acute isosceles triangle so that the outward edges of panels 242 and 244 and panels 142 and 144 are further apart at the edge of the blank than at the border of those side panels and their adjacent corner areas. The notches provide for panels 242, 244, 142 and 144 not interfering with the formation of a smooth miter edge when those panels are secured inside of their respective outer panels 222,224,122 and 124.

Each of front corner radius areas 121, 123, 141, and 143 and rear corner radius areas 221, 223, 241, and 243 have a plurality of parallel score lines, preferably seven lines scored on the outer surface of the box, for providing box 10 with rounded corners. Preferably, the score lines are equidistant and provide a uniform radius.

Box 10 also includes innerframe 300 which is secured to the interior of body 100 with innerframe front panel 310 having a lower portion secured in superposition to front body panel 120, innerframe side panel 320 secured in superposition to body side panel 244, and innerframe side panel 330 secured in superposition to body side panel 242. Front panel 310 also has an upper portion including upper front portions 312 and 314 which extend from above body 100 to the top of innerframe 300 and straddle a cut-out region. The cut-out region provides for easy removal of the product.

Innerframe 300 also has corner areas 321 and 323 which contain a plurality of score lines having a size and spacing selected so that the corner areas are provided with a radius that will nest closely with corresponding corner radius areas 221 and 223 of lid 200 and corner areas 121 and 123 of body 100. Innerframe 300 thus provides protection to the product when box 10 is open and provides a surface for frictionally receiving lid 200 in the closed position.

Innerframe 300 is substantially parallel to the surfaces of box 10. It is secured at a position whereby the top of innerframe 300 is close to the inside of lid 200, almost flush with the underside of top panel 230. Thus, in the closed position, lid front panel 220 and body front panel 120 are flush, preferably in the same plane. When the innerframes are formed from blanks, the cutout region of one blank is a panel extension in the lower portion of the front panel of the adjacent innerframe blank and the extension assists in the positioning of the innerframe in the body.

In accordance with one embodiment of box 10, innerframe 300 also includes rear corner areas 325 and 327 which nest in corresponding lid rear corners 243 and 241 and body rear corners 141 and 143. In addition, innerframe 300 may include rear panels 340 and 350 which are secured to rear body pack panel 140 and fit against lid rear panel 240.

Box 10 is used to contain products, and is particularly useful for containing a plurality of smoking articles, e.g., 20 cigarettes (not shown) wrapped in a foil liner 20. In this embodiment, the radius of the corners of box 10 and innerframe 300 are approximately the same as the radius of one smoking article, thereby providing a tight pack of the articles prior to the first opening of box 10. It is to be understood, however, that the precise dimensions and number of various flat panels and corner radius area score lines may be adjusted to obtain a package of a desired size for containing one or a plurality of desired products of a particular size. For example, if the box is used to contain relatively thin cigarettes, then corners may be provided with a smaller radius corresponding to the cigarette dimensions, and smaller body panels may be used.

Box 10 also may contain appropriate product labeling on its outer surfaces, for example, on one or more of the flat body pack and lid panels.

Figure 8:
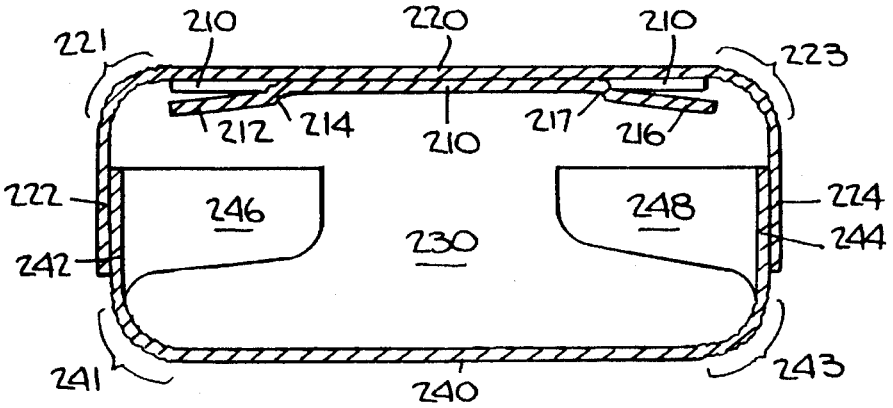
FIG. 8 is a sectional view taken along line 8—8 of FIG. 3.
Figure 12:
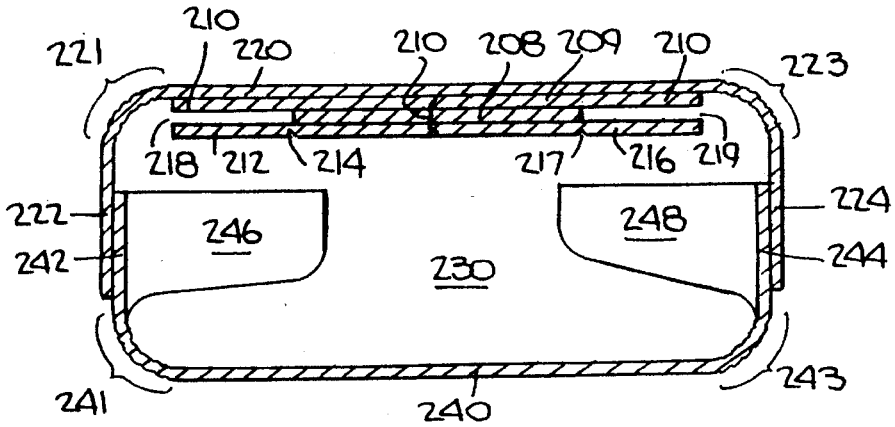
FIG. 12 is a bottom sectional view of a box lid in accordance with the embodiment of FIG. 11B.

In accordance with the present invention, lid 200 includes a second front lid panel 210 having approximately the same dimensions as lid front panel 220 that is secured in superposition to the inside of front lid panel 220. Referring to FIGS. 1, 2, 3, 5, 6, and 8, second front lid panel 210 preferably comprises slits 211 and 215 through the panel material, beginning at the outer edge of the blank and extending a distance into the interior of panel 210. Slits 211 and 215 create tabs 212 and 216 and permit tabs 212 and 216 to separate from panel 210 to engage the inside surface of innerframe 300 during closure. Tabs 212 and 216 are disposed so that when panel 210 is folded 180 degrees and secured to lid front panel 220, tabs 212 and 216 are not secured to panel 220 as shown in FIG. 8, and, during closure of lid 200, will engage the inside edges of innerframe 300 in the upstanding regions of areas 314 and 312 so as to pass between innerframe areas 312 and 314 and the product in box 10, specifically foil 20. Preferably, second front lid panel 210 also includes score lines 214 and 217 extending from respective slits 211 and 215 to the top edge of the blank. These score lines facilitate bending tabs 212 and 216 respectively.

Referring to FIG. 8, during reclosing of the lid, slits 211 and 215 receive the upper edges of front portions 312 and 314 of the innerframe to allow the latter to ride underneath tabs 212 and 216. Upon further closing, upper front portions 312 and 314 of the innerframe become slidingly engaged between tabs 212 and 216 and the inside surfaces of panel 210, respectively. Such engagement releasably interlocks the front lid panel to an upper front portion of box 10 in a fully closed position.

Referring to FIGS. 9, 9A, and 9B, an alternate embodiment is shown wherein tabs 212 and 216 each contain an embossed bead 213. Beads 213 are preferably positioned in the center of each tab 212 and 216 and function to raise at least the leading edges of tabs 212 and 216 proximate to panel 220, and preferably the entire tab, a short distance from panel 220. The short distance is sufficient so that during closure the leading edge will clear innerframe 300 and tabs 212 and 216 each will thus pass inside innerframe 300 and outside of any product contained within box 10.

Each of slits 211 and 215 also may be provided with a relatively short angled segment at the interior end. The angled slits provide some strain relief when panel 210 is secured to panel 220. The angled slits also permit tabs 212 and 216 to bend as a result of embossed beads 213 and further upon contacting areas 312 and 314 of innerframe 300 during closure.

In another preferred embodiment, shown in FIGS. 10, 10A, and 10B, panel 210 is provided with notches 218 and 219 in place of slits 211 and 215. Notches 218 and 219 provide a wider range of motion of tabs 212 and 216 and facilitate passage of tabs 212 and 216 between the product and innerframe while minimizing binding of tabs 212 and 216 relative to panel 210, innerframe 300, and any product. Notches 218 and 219 also reduce forces exerted on innerframe 300 areas 312 and 314 as compared to slits 211 and 215.

Referring to FIGS. 11, 11A, 11B, and 12, a preferred embodiment of the invention is shown. Panel 210 comprises tabs 212 and 216 and notches 218 and 219 substantially as described above with reference to FIG. 10. Panel 210 also includes an extension panel of material at the top end of the blank including panels 208 and 209. Panels 208 and 209 are separated from panel 210 by score line 206 extending the width of panels 208 and 209. Panels 208 and 209 are separated from each other by score line 207.

Panels 208 and 209 have a width that is approximately the same as the distance between the inner ends of notches 218 and 219 (or slits 211 and 215 in embodiments having slits), corresponding to score lines 214 and 217. Thus, panels 208 and 209 do not oppose tabs 212 and 216 so that tabs 212 and 216 are spaced a distance above the plane of panel 220, a distance that is about the sum of the thickness of panels 208 and 209. Preferably, panels 208 and 209 have about the same height, more preferably panel 208 is slightly shorter than panel 209 and panel 209 is about the same height as tabs 212 and 216.

The height of panels 208 and 209 may be adjusted so that when panel 210 is secured to panel 220, the portion of panel 210 that is to pass on the exterior of innerframe 300 is secured flush against panel 220, and the tabs 212 and 216 are elevated above panel 220 for engaging and passing on the inside of innerframe 300. Score lines 206 and 207 are preferably formed from a series of perforations so that when panels 208 and 209 are bent relative to the score lines, the score lines will provide a substantially flat fold.

In assembling the box in accordance with this embodiment, panel 208 is folded 180 degrees onto panel 209, and folded panels 208 and 209 are in turn folded 180 degrees onto panel 210, which is in turn folded 180 degrees onto panel 220 so that panel 208 is in contact with panel 210 and panel 209 is in contact with panel 220 and secured thereto. Preferably, panels are secured together by glue.

One advantage to this embodiment is that spacing tabs 212 and 216 from the surface of panel 220 minimizes the amount of bending tabs 212 and 216 will undergo during reclosure to engage and interlock with innerframe 300. This enhances the lifetime of the interlock mechanism.

It is to be understood that the interlock of the present invention will work with right angle corner boxes as well as rounded corner boxes.

Although the preferred embodiment as disclosed includes an innerframe having rear panels 340 and 350, a three-sided innerframe lacking such rear panels is also envisioned.

One skilled in the art will appreciate that the present invention can be practiced by other than the described embodiments, which are presented for purposes of illustration and not of limitation, and the present invention is limited only by the claims which follow.

I claim:

1. A hinged lid box for containing a product and having an open position and a closed position, comprising:

a lid having a first front panel having a top edge, a bottom edge, a first side edge and a second side edge, a second front panel having a third side edge and a fourth side edge, a first tab associated with the third side edge and a second tab associated with the fourth side edge, a rear panel, and means for connecting the second front panel in superposition to and within the boundaries of the first front panel with the first and second tabs disposed towards the first and second side edges of the first front panel;

a body having a front panel and a rear panel for containing the product therebetween;

an innerframe secured to the body, having a thickness and a front panel extending above the body having an outside surface facing the lid and an inside surface facing the product;

a hinge for connecting the lid rear panel to the body real panel so that the first and second tabs pass interior to the innerframe upper panel during closure of the box lid and the other portions of the second front panel pass exterior to the innerframe upper portion, thereby interlocking the lid to the frame; and means for raising the first and second tabs above the surface of the first front panel a predetermined distance.

2. The hinged lid box of claim 1 wherein the raising means further comprises a first embossed bead in the surface of the first tab and a second embossed bead in the surface of the second tab.

3. The hinged lid box of claim 1 wherein the raising means further comprises a third panel of material having a thickness, a fifth side edge and a sixth side edge, the first panel being interposed between the first front panel and second front panel so that the first tab overhangs the sixth side edge and the first and second tabs are spaced above the first front panel by about the thickness of the third panel.

4. A hinged lid box for containing a product and having an open position and a closed position, comprising:

a lid having a first front panel having a top edge, a bottom edge, a first side edge and a second side edge, a second front panel having a third side edge and a fourth side edge, a first tab associated with the third side edge and a second tab associated with the fourth side edge, a rear panel, and means for connecting the second front panel in superposition to and within the boundaries of the first front panel with the first and second tabs disposed towards the first and second side edges of the first front panel;

a body having a front panel and a rear panel for containing the product therebetween;

an innerframe secured to the body, having a thickness and a front panel extending above the body having an outside surface facing the lid and an inside surface facing the product; and a hinge for connecting the lid rear panel to the body real panel so that the first and second tabs pass interior to the innerframe upper panel during closure of the box lid and the other portions of the second front panel pass exterior to the innerframe upper portion, thereby interlocking the lid to the frame;

wherein the second front panel and the first and second tabs further comprise a first slit and a second slit, the first slit extending from one of the third or fourth side edges of the second front panel a first distance into the interior of the second from panel, the second slit extending from the other of the third or fourth side edges a second distance into the interior of the second front panel, the first and second slits thereby defining the first and second tabs;

wherein the second from panel and the first and second tabs further comprise a first score line extending between the interior end of the second slit and one of the top or bottom edges of the second from panel, the first and second score lines and first and second slits thereby defining the first and second tabs;

said hinged lid box further comprising means for raising the first and second tabs above the surface of the first front panel a predetermined distance.

5. The hinged lid box of claim 4 wherein the raising means further comprises a first embossed bead in the surface of the first tab and a second embossed bead in the surface of the second tab.

6. The hinged lid box of claim 5 wherein the first slit further comprises a third slit at the interior end of the first slit, the third slit being at an angle to the first slit, the second slit further comprises a fourth slit at the interior end of the second slit, the fourth slit being at an angle to the second slit, the third and fourth slits being angled away from the first and second tab.

7. The hinged lid box of claim 4 wherein the raising means further comprises a third panel of material having a thickness, a fifth side edge and a sixth side edge, the third panel being interposed between the first front and second front panels so that the first tab overhangs the fifth side edge and the second tab overhangs the sixth side edge and the first and second tabs are spaced above the first front panel by about the thickness of the third panel.

8. A hinged lid box for containing a product and having an open position and a closed position, comprising:

a lid having a first front panel having a top edge, a bottom edge, a first side edge and a second side edge, a second front panel having a third side edge and a fourth side edge, a first tab associated with the third side edge and a second tab associated with the fourth side edge, a rear panel, and means for connecting the second front panel in superposition to and within the boundaries of the first front panel with the first and second tabs disposed towards the first and second side edges of the first front panel;

a body having a front panel and a rear panel for containing the product therebetween;

an innerframe secured to the body, having a thickness and a front panel extending above the body having an outside surface facing the lid and an inside surface facing the product; and a hinge for connecting the lid rear panel to the body real panel so that the first and second tabs pass interior to the innerframe upper panel during closure of the box lid and the other portions of the second front panel pass exterior to the innerframe upper portion, thereby interlocking the lid to the frame;

wherein the lid is formed from a blank including the first front panel and the second front panel separated by a first score line, the second front panel being folded 180 degrees about the first score line to form the superimposed first front and second front panels;

wherein the second front panel and the first and second tabs further comprise a first slit and a second slit, the first slit extending from one of the third or fourth side edges of the second front panel a first distance into the interior of the second front panel, the second slit extending from the distance into the interior of the second from panel, the first and second slits thereby defining the first and second tabs;

wherein the second front panel and the first and second tabs further comprise a second score line extending between the interior end of the first slit and the top edge of the second front panel, and a third score line extending between the interior end of the second slit and the top edge of the second from panel, the second and third score lines and first and second slits thereby defining the first and second tabs;

said hinged lid box further comprising means for raising the first and second tabs above the surface of the first from panel a predetermined distance.

9. The hinged lid box of claim 8 wherein the raising means further comprises a first embossed bead in the surface of the first tab and a second embossed bead in the surface of the second tab.

10. The hinged lid box of claim 9 wherein the first slit further comprises a third slit at the interior end of the first slit, the third slit being at an angle to the first slit, and wherein the second slit further comprises a fourth slit at the interior end of the second slit, the fourth slit being at an angle to the second slit, the third and fourth slits being angled away from the first and second tabs.

11. The hinged lid box of claim 8 wherein the raising means further comprises a third panel of material extending from the second panel of material and separated therefrom by a fourth score line, the third panel having a width less than the width of the second panel, the third panel being folded 180 degrees about the fourth score line so that the first and second tabs are spaced above the first front panel by the third panel.

12. The hinged lid box of claim 11 wherein the third panel further comprises a fourth panel of material and a fifth panel of material, the fourth and fifth panels being defined by a fifth score line, the fourth and fifth panels being folded 180 degrees about the fifth score line, the folded fourth and fifth panels being folded about the fourth score line, and the folded second, fourth and fifth panels being folded about the third score line so that the first and second tabs are spaced from the first front panel by the fourth and fifth panels.

13. In a box for containing a product and having a lid and a body hinged together having an open position and a closed position and an innerframe secured in the body and extending into the lid, a system for maintaining the lid in the closed position comprising:

a first panel being part of the innerframe extending above the body having an exterior surface facing the lid and an inside surface facing the product;

a second panel being part of the lid having a first height and a first width;

a third panel having a second height between a top edge and a bottom edge, a second width between a first side edge and a second side edge, and a tab;

means for securing the third and second panels together in superposition so that the tab passes inside the first panel during closure of the lid and the other portions of the third panel pass outside the first panel during closure, thereby interlocking the lid and innerframe;

wherein the third panel and the tab further comprise a first tab at one end of the second width and a second tab at the other end of the second width, and wherein the securing means further comprises means for securing the second and third panels so that the first and second tabs pass inside the first panel during closure of the lid; and wherein the lid further comprises means for raising the first and second tabs above the surface of the second panel a predetermined distance.

14. The system of claim 13 wherein the predetermined distance is the thickness of the innerframe.

15. The system of claim 13 wherein the first tab further comprises a first slit extending from one end of the second width to the interior of the third panel and a first score line extending between the interior end of the first slit and the top edge of the second panel and wherein the second tab further comprises a second slit extending from the other end of the second width to the interior of the third panel and a second score line extending between the interior end of the second slit and the top edge of the third panel.

16. The system of claim 15 wherein the first panel further comprises a first upstanding portion and a second upstanding portion, the first and second upstanding portions being spaced apart so that the first tab passes inside one of the first or second upstanding portions and the second tab passes inside the other of the first or second upstanding portions.

17. The system of claim 15 wherein the raising means further comprises a first embossed bead located in the first tab and a second embossed bead located in the second tab.

18. The system of claim 15 wherein the raising means further comprises a fourth panel of material having a third width and a third height, the fourth panel being interposed between the third and second panels so that the first and second tabs are spaced above the second panel by the fourth panel, the third height being at about or less than the distance between the top edge of the third panel and the first and second slits.

19. The system of claim 16 wherein the lid is made from a blank and the third panel of material and the raising means further comprise a blank section extending from the second panel and separated therefrom by a third score line, the blank section including the third panel, a fourth panel, and a fifth panel, the third and fourth panels being separated by a fourth score line, the fourth and fifth panels being separated by a fifth score line, the fifth panel being folded 180 degrees about the fifth score line onto the fourth panel, the fourth panel being folded 180 degrees about the fourth score line onto the third panel, the third panel being folded 180 degrees about third score line onto the second panel so that fifth panel is interposed between the fourth and third panels, the fourth panel is in contact with the second panel, and the fourth and fifth panels are interposed between the second and third panels, the fourth and fifth panels having a width less than the second width so that the first and second tabs are spaced above the second panel by the fourth and fifth panels and pass inside the first panel during closure, the fourth and fifth panels having a height so that a portion of the third panel is secured to the second layer and passes exterior to the first panel during closure.

20. The system of claim 13 wherein the first tab further comprises a first notch extending from one end of the second width to the interior of the third panel and a first score line extending between the interior end of the first notch and the top edge of the second panel and wherein the second tab further comprises a second notch extending from the other end of the second width to the interior of the third panel and a second score line extending between the interior end of the second notch and the top edge of the third panel.

21. The system of claim 20 wherein the first panel further comprises a first upstanding portion and a second upstanding portion, the first and second upstanding portions being spaced apart so that the first tab passes inside one of the first or second upstanding portions and the second tab passes inside the other of the first or second upstanding portions.

22. The system of claim 20 wherein the raising means further comprises a first embossed bead located in the first tab and a second embossed bead located in the second tab.

23. The system of claim 20 wherein the raising means further comprises a fourth panel of material having a third width and a third height, the fourth panel being interposed between the third and second panels so that the first and second tabs are spaced above the second panel by the fourth panel, the third height being at about or less than the distance between the top edge of the third panel and the first and second notches.

24. The system of claim 23 wherein the lid is made from a blank and the third panel of material and the raising means further comprise a blank section extending from the second panel and separated therefrom by a third score line, the blank section including the third panel, a fourth panel, and a fifth panel, the third and fourth panels being separated by a fourth score line, the fourth and fifth panels being separated by a fifth score line, the fifth panel being folded 180 degrees about the fifth score line onto the fourth panel, the fourth panel being folded 180 degrees about the fourth score line onto the third panel, the third panel being folded 180 degrees about third score line onto the second panel so that fifth panel is interposed between the fourth and third panels, the fourth panel is in contact with the second panel, and the fourth and fifth panels are interposed between the second and third panels, the fourth and fifth panels having a width less than the second width so that the first and second tabs are spaced above the second panel by the fourth and fifth panels and pass inside the innerframe during closure, the fourth and fifth panels having a height so that a portion of the third panel is secured to the second layer and passes exterior to the innerframe during closure.

* * * * *